US010308429B2

(12) United States Patent
McNeilus et al.

(10) Patent No.: US 10,308,429 B2
(45) Date of Patent: Jun. 4, 2019

(54) BELT OPERATED CONTAINER HANDLING SYSTEM FOR SIDE LOADER

(71) Applicant: Con-Tech Manufacturing, Inc., Dodge Center, MN (US)

(72) Inventors: Grant McNeilus, Dodge Center, MN (US); Brian R. Meldahl, Brownsdale, MN (US)

(73) Assignee: Con-Tech Manufacturing, Inc., Dodge Center, MN (US)

( * ) Notice: Subject to any disclaimer, the term of this patent is extended or adjusted under 35 U.S.C. 154(b) by 0 days.

(21) Appl. No.: 15/353,255

(22) Filed: Nov. 16, 2016

(65) Prior Publication Data

US 2018/0134487 A1 May 17, 2018

(51) Int. Cl.

| | |
|---|---|
| ***B65F 1/12*** | (2006.01) |
| ***B65F 3/04*** | (2006.01) |
| ***B65F 3/08*** | (2006.01) |
| *B65F 3/02* | (2006.01) |

(52) U.S. Cl.

CPC ..... *B65F 3/041* (2013.01); *B65F 3/08* (2013.01); *B65F 2003/023* (2013.01); *B65F 2003/0276* (2013.01)

(58) Field of Classification Search

CPC ..... B65F 1/122

USPC ..... 414/406, 408, 409

See application file for complete search history.

(56) References Cited

U.S. PATENT DOCUMENTS

| | | | | |
|---|---|---|---|---|
| 5,007,786 A * | 4/1991 | Bingman | ..... | B65F 3/001 414/409 |
| 5,702,225 A | 12/1997 | Ghibaudo | | |
| 7,559,735 B2 | 7/2009 | Pruteanu et al. | | |
| 9,403,641 B1 * | 8/2016 | Ghibaudo | ..... | B65F 3/02 |

* cited by examiner

*Primary Examiner* — Saul Rodriguez
*Assistant Examiner* — Willie Berry, Jr.
(74) *Attorney, Agent, or Firm* — Craig J. Lervick; Larkin Hoffman Daly & Lindgren, Ltd.

(57) ABSTRACT

A simplified lift and lowering system is provided that includes a base carriage arrangement that operates along a stationary belt attached to a pivoting arm. The arm has a lower end that is capable of linear lateral extensions and the upper end that returns to the same position when the arm is retracted. The arm has a curved upper portion and is mounted to discharge or dump containers into the charging hopper section of a side-loading refuse vehicle. The stationary belt is carried in a recessed central area of the arm and is anchored at the upper end of the curved section of the arm and attached to a spring-loaded belt tensioner at the lower end of the arms.

18 Claims, 10 Drawing Sheets

BELT OPERATED CONTAINER HANDLING SYSTEM FOR SIDE LOADER

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to container handling equipment, including systems for accessing, grabbing, lifting and tipping a wide range of sizes and shapes of collection containers into charging hoppers or compartments of side loading collection vehicles, or other receptacles, and thereafter returning empty containers to their pickup locations. More particularly, the present invention relates to an automated container handling system including a pivoting arm and a base carriage arrangement that carries a mechanized container grabbing device. The arm is capable of lateral extension, and also capable of full lift and dump operation. A linearly-operating lift system is provided that enables the basic carriage and container grabbing device operates along a stationary belt attached to the arm to lift and lower containers held by the grabbing device.

II. Related Art

Various vehicles dedicated to the collection of refuse or recyclables have included mechanized container handling devices that allow an operator to cause the device to access, lift, empty and return containers of interest without the need for any direct interaction by the operator so that the operator may remain in the vehicle. Such a holding or grabbing device is generally connected to an arm or extendable boom which is connected, in turn, to a base mounted on the vehicle. The arm or boom and grabbing device are operated in concert to access and engage a container of interest, lift and dump the container into a receiving hopper and return the empty container to the original location. Grabbing devices are also known which have opposed arms or fingers that converge around the girth of containers. Such devices generally have themselves been attached to extendable arm members configured to pivot in a generally vertical plane to lift and invert a captured container and return it empty to an upright position.

Systems also have been devised in which converging/diverging gripper arms are mounted on a carriage to reciprocate along a lift assembly using a chain drive.

Mechanisms of known container handling devices generally have a large number of moving parts and articulated joints which are exposed to the extreme clogging and corrosive conditions of refuse collection, and, as such, tend to require frequent maintenance. It would thus be advantageous to provide a simplified mechanism to enable a base carriage and carried container grabbing device to automatically operate along a lift and dump arm that reduces mechanism complexity and maintenance requirements.

SUMMARY OF THE INVENTION

By means of the present invention, there is provided a simplified lift and lowering system that includes a base carriage that operates along a stationary belt attached to a pivoting arm. The arm has a lower end that is capable of lateral extensions and the upper end that returns to the same position when the arm is retracted. The arm has a curved upper portion and is mounted to discharge or dump containers into the charging hopper section of a side-loading refuse vehicle. The stationary belt is carried in a recessed central area of the arm and is anchored at the upper end of the curved section of the arm and attached to a spring-loaded belt tensioner at the lower end of the arms. The underside of the belt has a tread designed to ride over a drive pulley or sprocket without slipping.

The base carriage arrangement includes a hydraulic motor designed to operate a drive pulley or sprocket that moves the carriage arrangement along using the underside of the belt. The belt is held against the drive pulley by a pair of flanking idler pulleys. The drive pulley or sprocket operates along the belt to raise and lower the carriage arrangement along the pivoting arm. The curved upper section of the arm returns to the same position in relation to the corresponding charging or receiving hopper when the arm is fully retracted to lift and dump a container in the same place in relation to the hopper.

A container grabber is attached to the base carriage arrangement and may be operated by a hydraulic actuating system to capture and release containers to be emptied and is preferably one comprising opposed spaced fingers that are mounted to spaced mounting shafts that rotate to open and close the fingers.

DETAILED DESCRIPTION

The following detailed description is intended to be exemplary of a preferred apparatus and method of utilizing the concepts of the present invention and is not intended to exhaustive or limiting in any manner with respect to similar devices and methods and other variations which might occur to those skilled in the art. The following description further utilizes an illustrative example which is believed sufficient to convey an adequate understanding of the broader concepts to those skilled in the art, and exhaustive examples are believed unnecessary.

Figure 1:
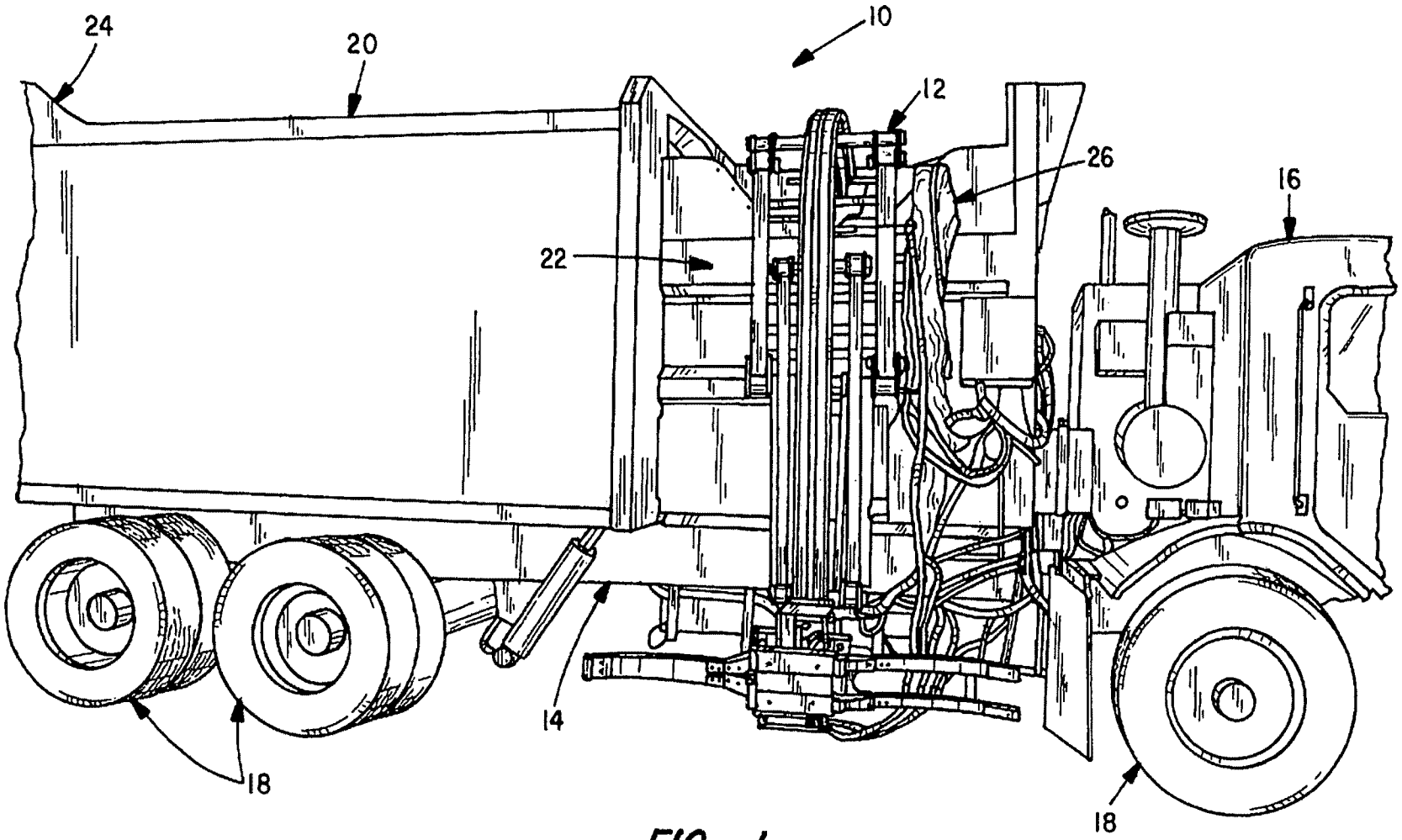
FIG. 1 is a side elevational view of a side-loading refuse truck provided with the container handling system of the invention.

FIG. 1 depicts a side elevational view of a side-loading refuse truck, generally at 10, incorporating the container handling system of the invention, shown generally at 12, mounted on the truck. The vehicle includes a chassis 14, a cab shown partially at 16 and wheels 18. The vehicle body includes a storage chamber 20 which is connected to a charging hopper 22 and a tailgate (not shown) which is pivotally carried by a pair of vertically operating hinges, one of which is partially shown at 24 mounted at the top rear of the storage chamber. The tailgate is operated to open and close by hydraulic cylinders (not shown) and the vehicle body in conjunction with the operation of the tailgate, is tilted by further hydraulic cylinders (also not shown), to discharge stored refuse. Operation of the tailgate and truck body are well known. Electrical and hydraulic connections to the container handling system are shown at 26.

The automated container handling system 12 is best depicted in FIGS. 2A-5 and includes a main arm 30 mounted to swivel about an upper support member 32 at the upper end.

Figure 2A:
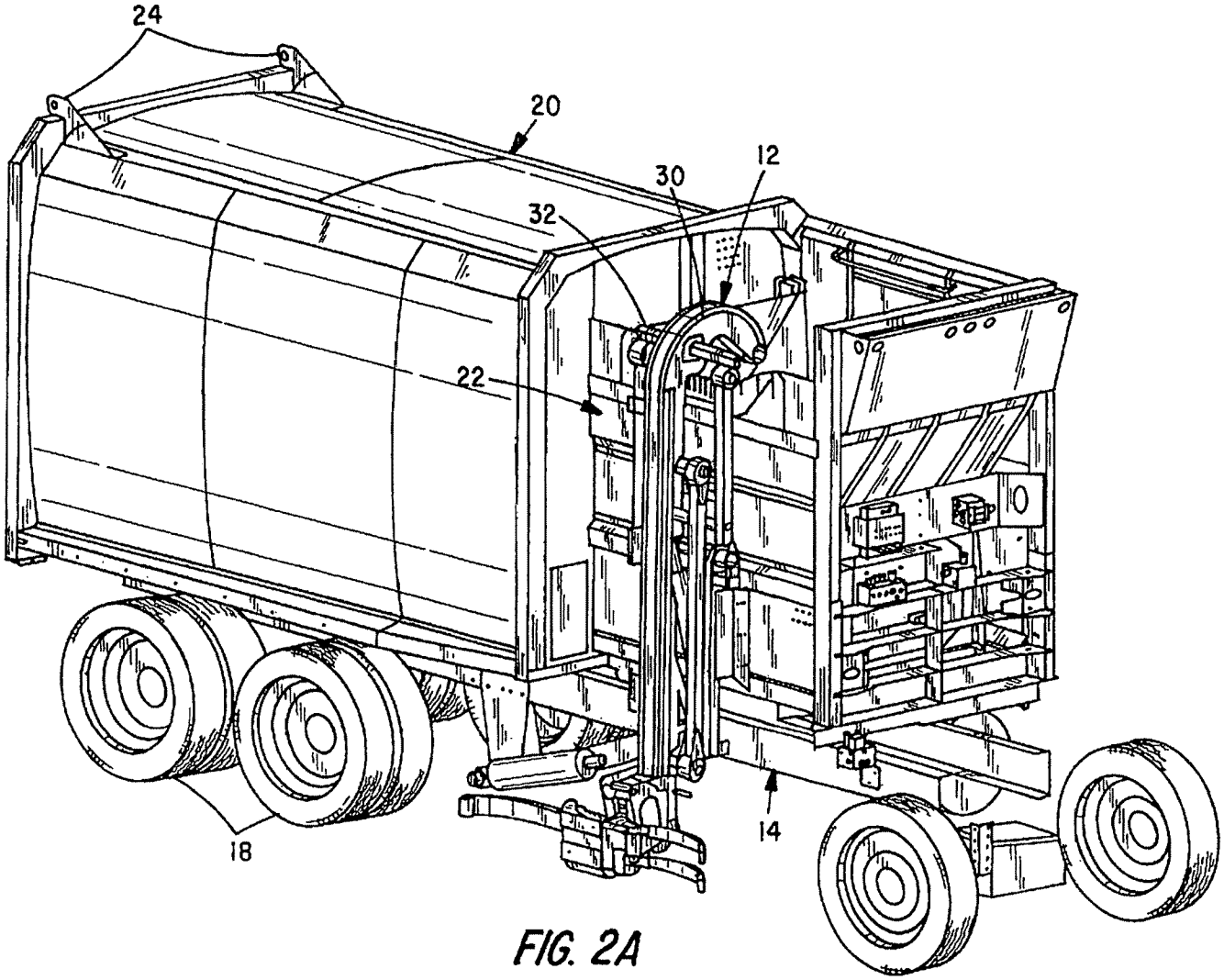
FIG. 2A is a perspective view of a side-loading refuse vehicle with the cab removed for clarity showing the container handling system of the invention with the base carriage in the fully lowered position.
Figure 2B:
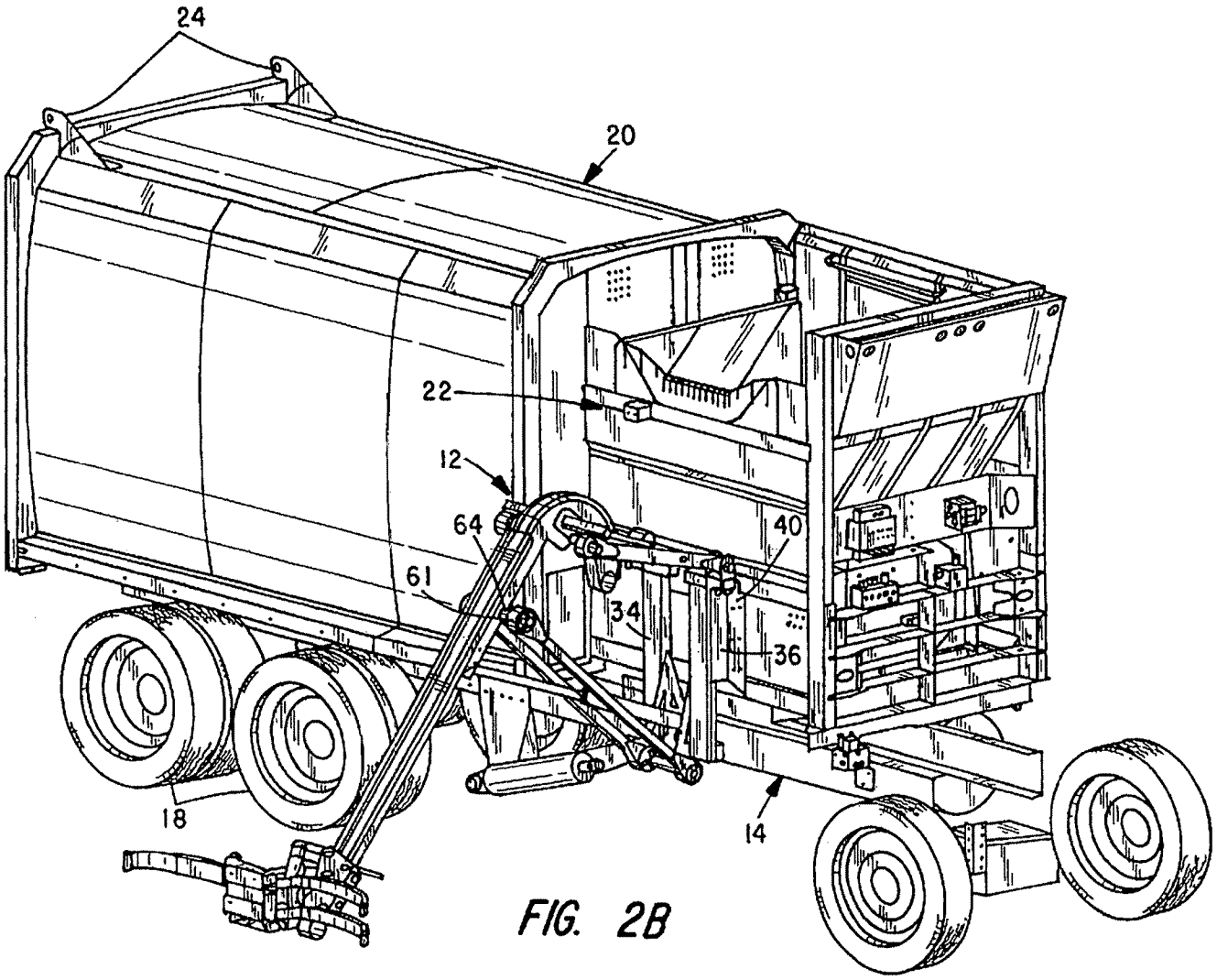
FIG. 2B is a view similar to FIG. 2A with the pivoting arm fully extended laterally.
Figure 2C:
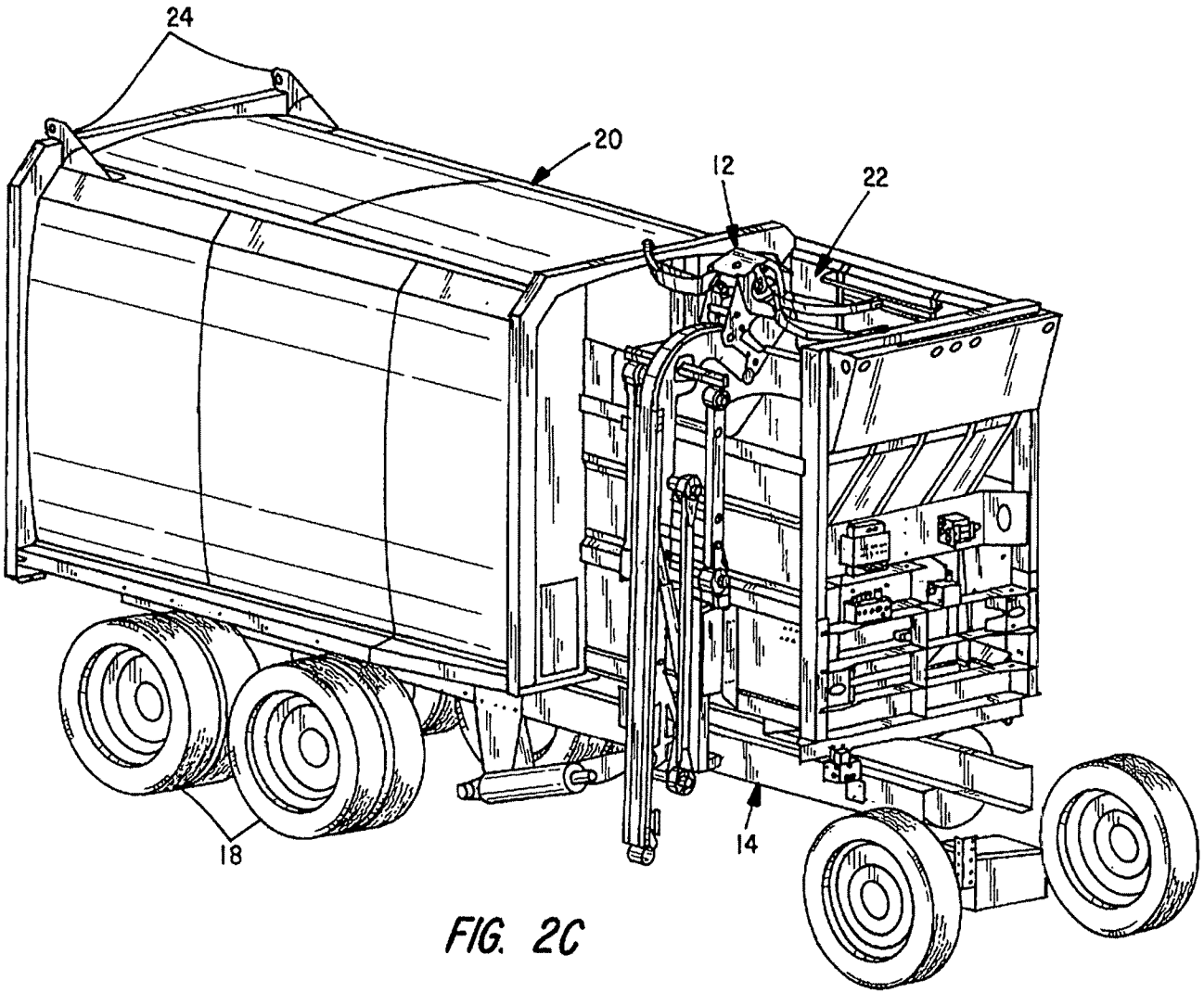
FIG. 2C is a view similar to FIG. 2A showing the base carriage in the container dumping position.
Figure 3:
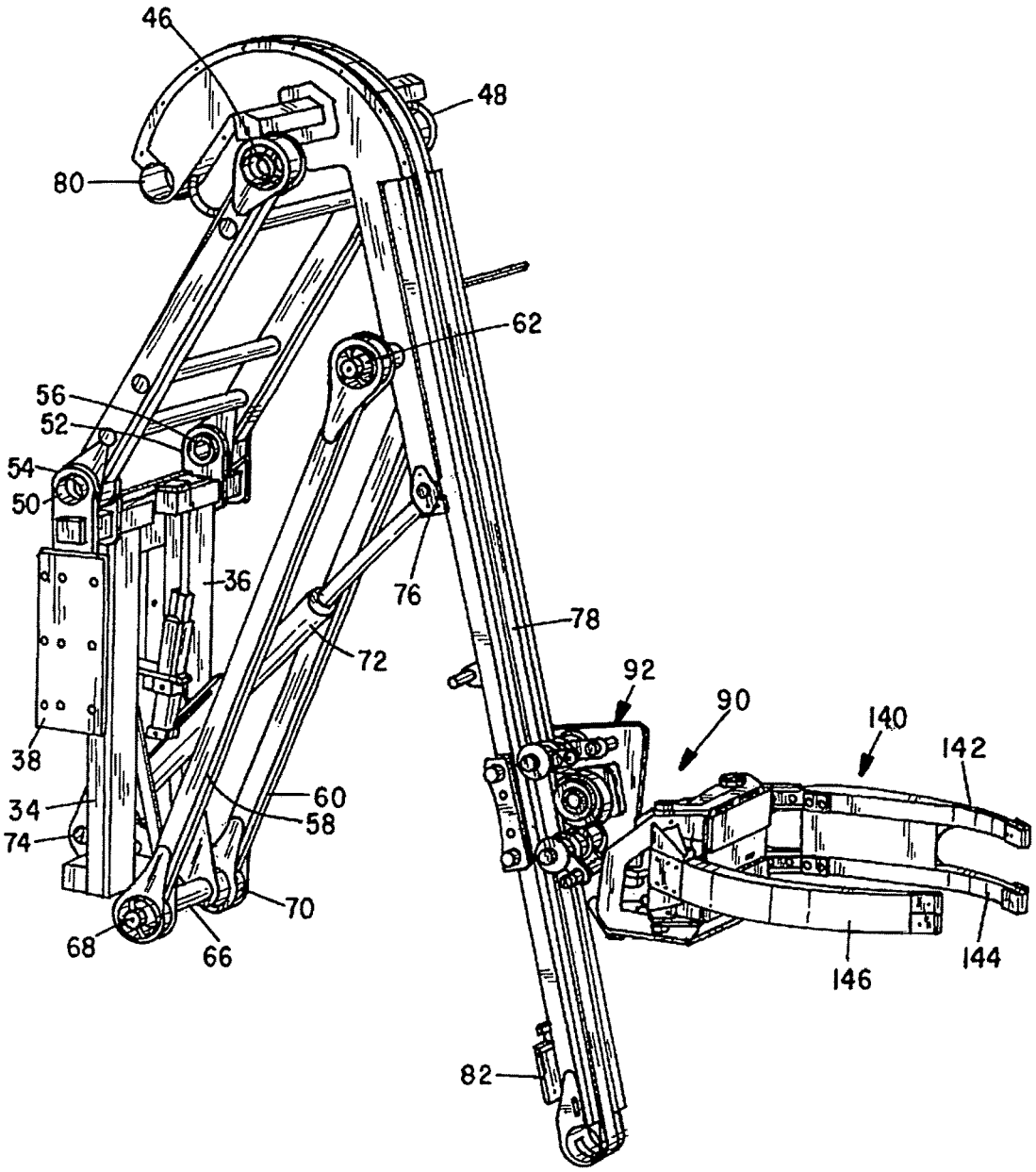
FIG. 3 is a perspective view of the container handling system of the invention with the arm partially extended.
Figure 4:
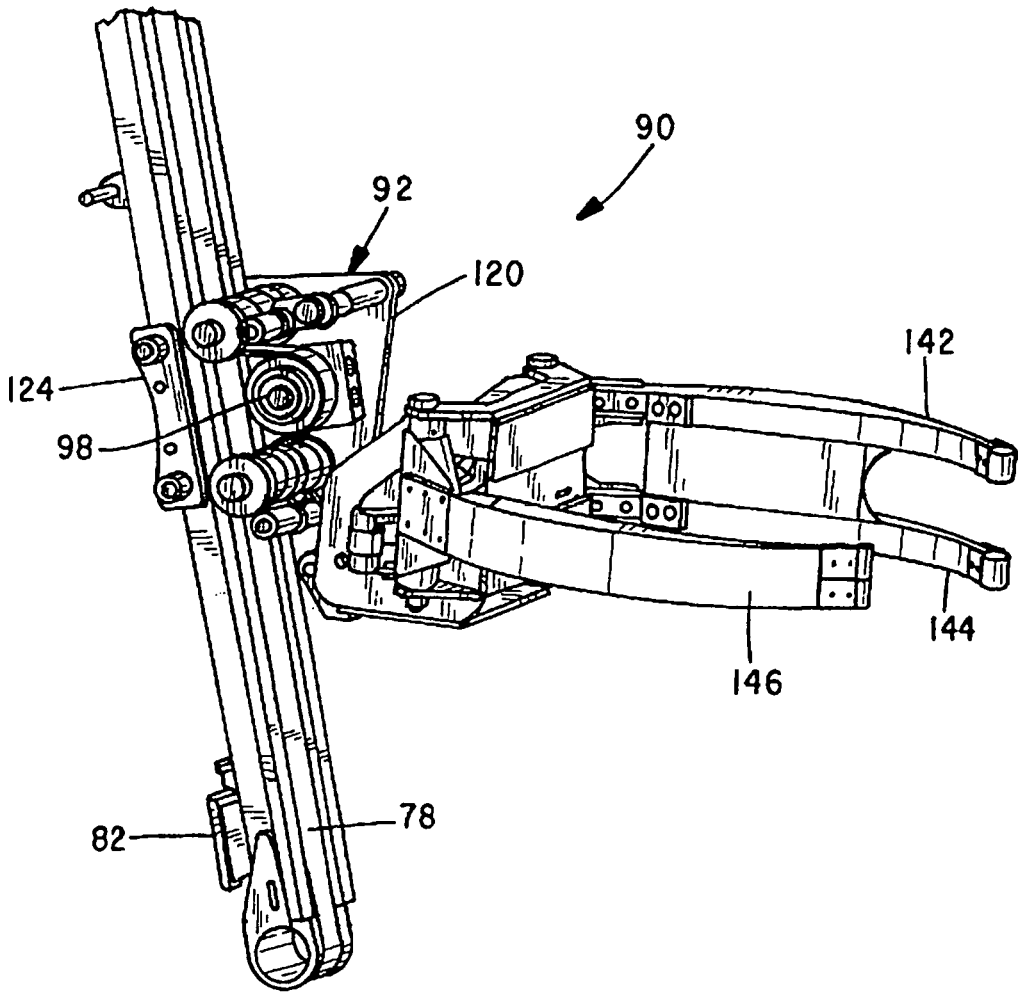
FIG. 4 is an enlarged fragmentary view of a portion of FIG. 3.
Figure 5:
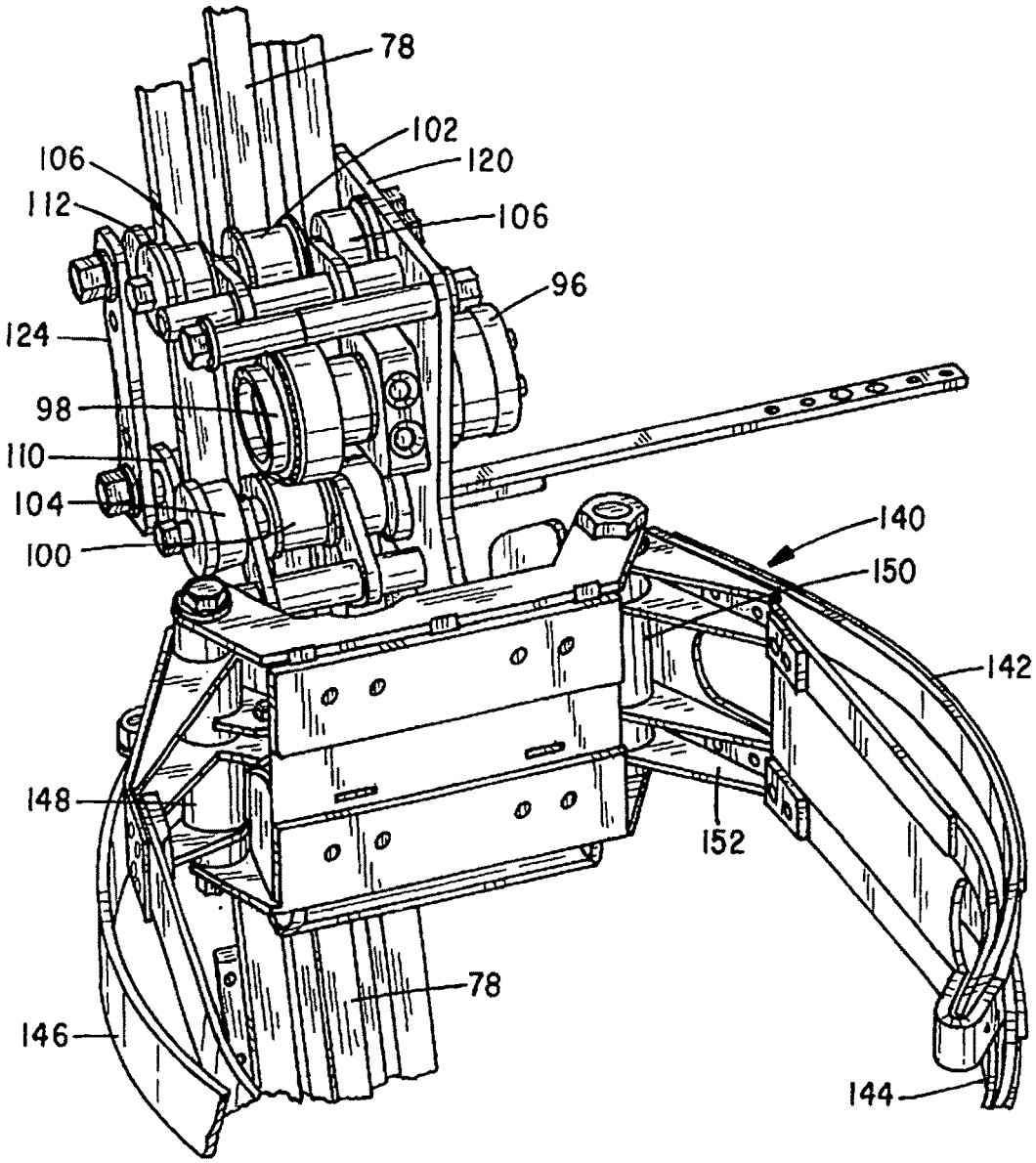
FIG. 5 is a further enlarged fragmentary front perspective view showing the base carriage.

As best seen in FIGS. 2B and 3, the arm 30 has a support structure which includes vertical shapes 34 and 36 designed to be fixed to the side of the charging hopper as by plate shapes 38 and to member 32. A pair of spaced struts 42 and 44 are pivotally attached to upper support member 32 at 46 and 48 and fixed support shapes 50 and 52 at 54 and 56, respectfully. The pivoting spaced struts 42 and 44 enable the upper part of the arm 30 to move laterally and downward when the arm is extended laterally. Further, spaced struts 58 and 60 are pivotally mounted to a member 61 attached to the arm 30 as at 62 and 64 and to a lower member 66 attached to a structure designed to be fixed to a truck as at 68 and 70. The lateral movement of the arm 30 is controlled by a pivotally mounted hydraulic cylinder 72 connected between joints 74 and 76. The arm includes a heavy belt 78 which extends the length of arm 30 and is anchored at the top at 80. The lower end of the belt is connected to a spring-loaded belt tensioner at 82 which includes a clamping device that fixes the end of the belt.

A base carriage arrangement is shown generally at 90 and is best seen in FIGS. 4, 5 and 6A-6C. The base carriage arrangement includes a carriage with a drive system 92 and an attached grabber system 140.

The drive system is best shown in FIGS. 5 and 6A-6C and includes a hydraulic motor 96 that is connected to an operates a drive sprocket or pulley 98 that rides on the underside of the belt 78 which has a tread compatible with the sprocket or pulley 98. The belt 78 may be fabricated from a carbon fiber material, a rubber blend or any other suitable material. Idler pulleys 100 and 102 flank sprocket 98 and are provided to maintain the belt tension around sprocket 98.

Figure 6A:
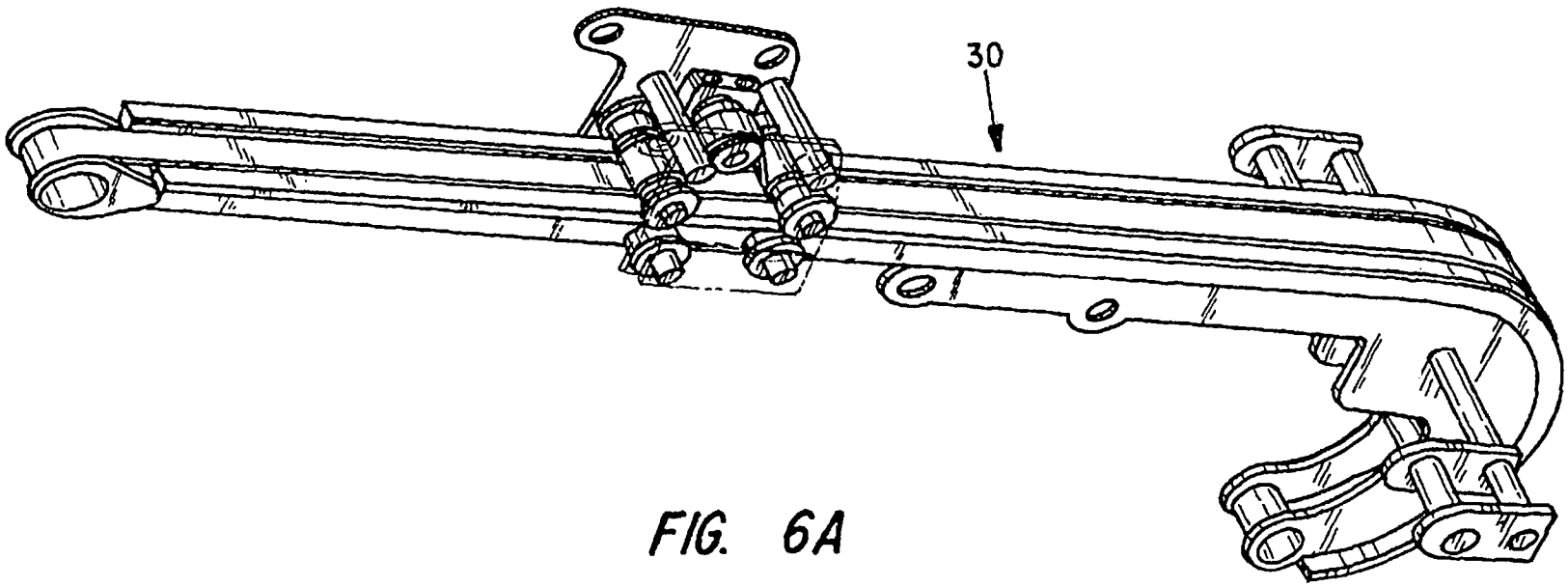
FIG. 6A is a reduced perspective view of a pivoting arm and a base carriage with the grabber removed for clarity.
Figure 6B:
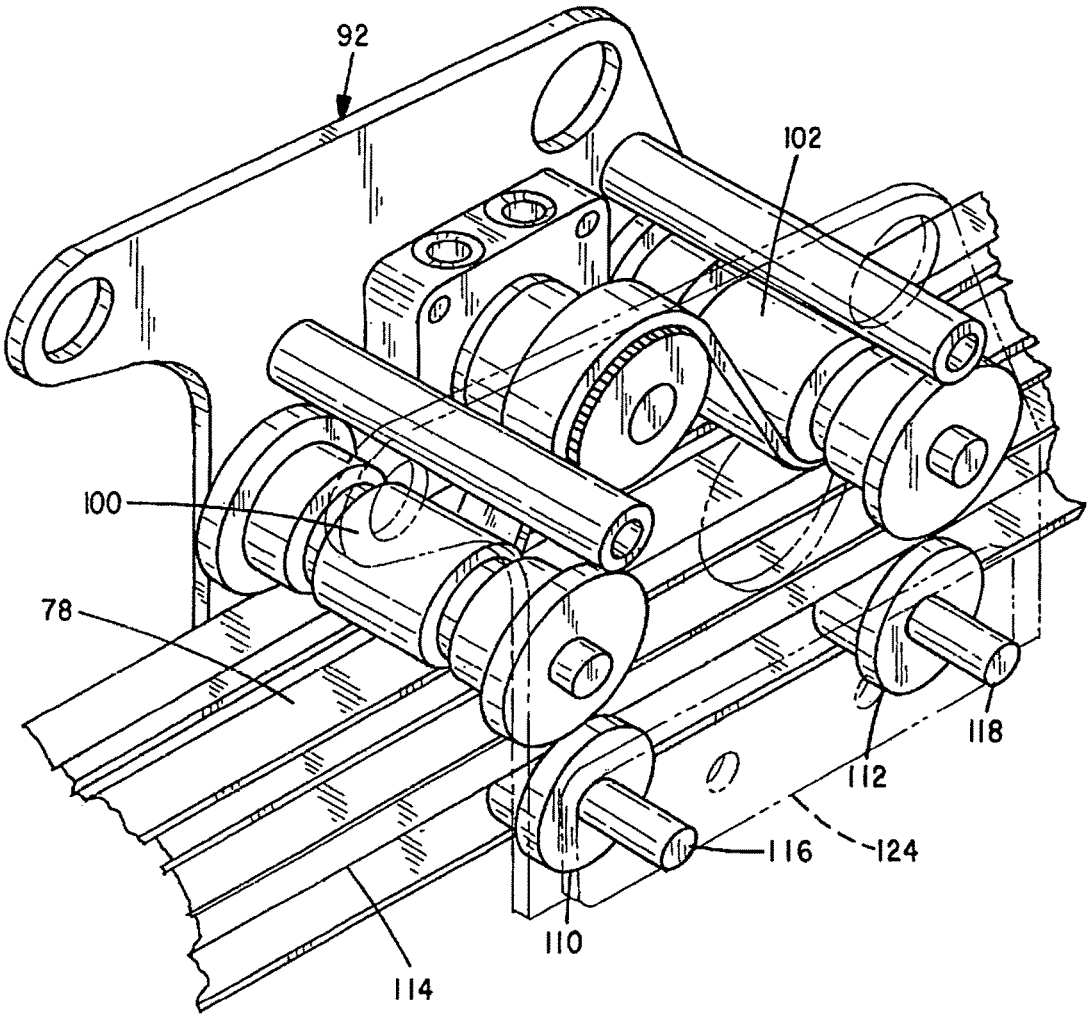
FIG. 6B is an enlarged perspective view of the base carriage circled in FIG. 6A.
Figure 6C:
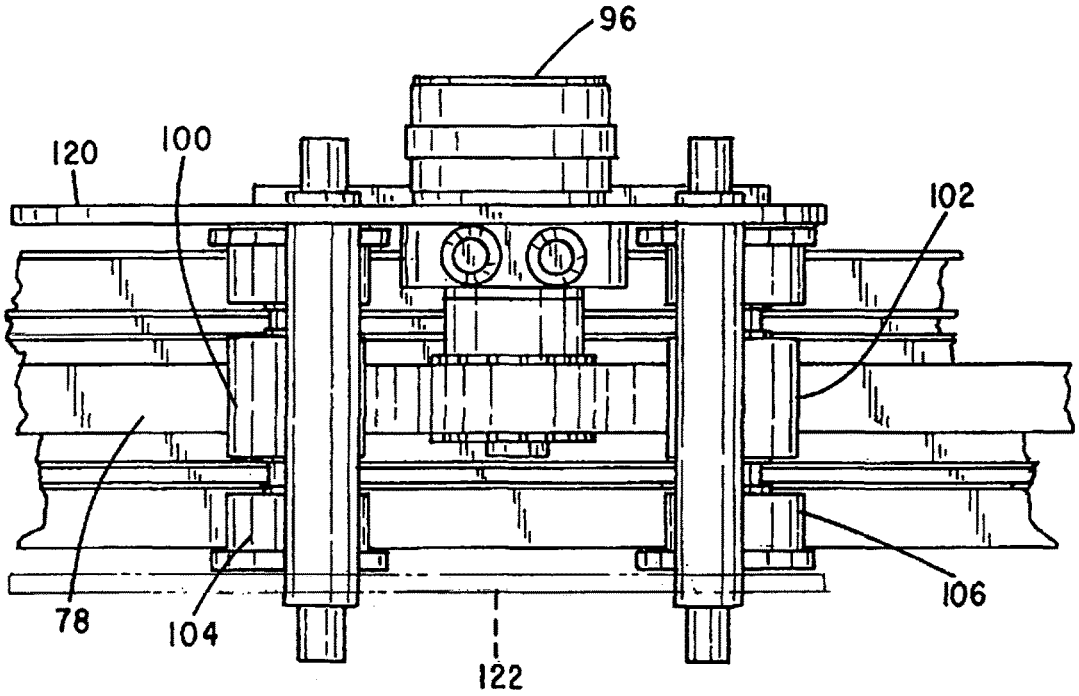
FIG. 6C is a top view of the carriage of FIG. 6B with parts removed for clarity.

The base carriage arrangement 90 rides along the arm 30 on sets of flanged rollers. Upper or top side roller sets are shown at 104 and 106. Rollers 104 and 106 are on common shafts 108 and 110 with idler pulleys 102 and 104, respectively. Pairs of flanged lower rollers or guide wheels, one of each pair being shown at 110 and 112 in FIG. 6B are located on either side of arm 30 and ride in grooves in arm 30 as at 114. Common shafts 116 and 118 connect beneath arm 30 and are supported by structured plate shapes 120 and 122, 122 being shown in phantom for clarity. The lower guide wheels with the associated structure secure the carriage 92 to the arm 30. The structure further includes side plates, one of which is shown at 124. The hydraulic motor 96 operates to move base carriage arrangement 90 up and down along the arm 30 to lift, dump, lower and return containers to their assigned spots.

A container grabber 140 is attached to the base carriage and includes spaced, opposed finger elements, one may have split members as at 142 and 144 and the other a single element as at 146. The opposed finger elements are attached to rotating members as at 148 and 150 (FIG. 5) as by a plurality of plate members as at 152.

In operation, the refuse truck stops with the container handling system alongside of a container of interest to be emptied. The arm is then advanced laterally with the grabber fully open until the grabber is close to the container. The grabber is then operated to capture the container and thereafter the arm is retracted to an upright position and the base carriage is raised and the container emptied into the loading hopper.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A belt operated container handling system for a side loading refuse truck comprising:

(a) a pivoting laterally extendable arm having a curved upper portion, a recessed central area extending along the arm, a permanently stationary belt member having an underside tread carried in said recessed central area;

(b) a base carriage arrangement supported as and adapted to travel along said pivoting laterally extendable arm by travelling along said belt using said underside tread, said base carriage arrangement further comprising a hydraulic motor attached to a drive sprocket, said drive sprocket compatible with and configured to travel along the underside tread of said belt for moving said base carriage along said arm; and (c) a container grabber carried by said base carriage arrangement for capturing and releasing containers to be emptied.

2. A belt operated container handling system as in claim 1 further comprising a support structure for said pivoting laterally extendable arm adapted to be attached to a side loading refuse truck and including pivoting members that enable the upper portion of the arm to be lowered as the bottom linearly extends a hydraulic cylinder for controlling the later extension and retraction of said arm.

3. A belt operated container handling system as in claim 1 wherein said drive sprocket is flanked by a pair of spaced idler sprockets for maintaining said belt on said drive sprocket.

4. A belt operated container handling system as in claim 3 wherein said stationary belt member is anchored at the upper curved portion of the pivoting laterally extendable arm and held by an adjustable tensioning device at the lower end of said arm.

5. A belt operated container handling system as in claim 3 further comprising rollers and guide wheels for carrying said base carriage arrangement along said pivoting, laterally extending arm.

6. A belt operated container handling system as in claim 1 wherein said stationary belt member is anchored at the upper curved portion of the pivoting laterally extendable arm and held by an adjustable tensioning device that includes a clamping device at the lower end of said arm.

7. A belt operated container handling system as in claim 6 further comprising rollers and guide wheels for carrying said base carriage arrangement along said pivoting, laterally extending arm.

8. A belt operated container handling system as in claim 7 wherein said guide wheels are connected under said pivoting laterally extending arm in pairs, each pair having a single shaft which with associated structure maintains said base carriage arrangement and said pivoting laterally extending arm.

9. A belt operated container handling system as in claim 1 wherein said belt is carried in said recessed central area such that said underside tread is facing an interior portion of said recessed central area.

10. A belt operated container handling system as in claim 9 further comprising an adjustable tensioning device coupling said stationary belt member to said pivoting laterally extendable arm, said adjustable tensioning device comprising a clamping device affixed to an end of said stationary belt member.

11. A belt operated container handling system for a side loading refuse truck comprising:

a pivoting laterally extendable arm having a curved upper portion, a recessed central area extending along the arm;

a permanently stationary belt member having a first end coupled to a first end of said laterally extendable arm and a second end coupled to a second end of said laterally extendable arm, said belt member having an underside tread carried in and shielded by said recessed central area;

a base carriage arrangement supported by and adapted to travel along said laterally extendable arm, said base carriage arrangement further comprising a hydraulic motor attached to a drive sprocket, said drive sprocket compatible with and configured to travel along said underside tread of said belt member wherein operation of said hydraulic motor causes movement of said base carriage along said arm; and a container grabber carried by said base carriage arrangement for capturing and releasing containers to be emptied.

12. The belt operated container handling system of claim 11 further comprising a support structure for said pivoting laterally extendable arm adapted to be attached to a side loading refuse truck and including pivoting members that enable the upper portion of the arm to be lowered as the bottom linearly extends a hydraulic cylinder for controlling the later extension and retraction of said arm.

13. The belt operated container handling system of claim 11 wherein said drive sprocket is flanked by a pair of spaced idler sprockets for maintaining said belt on said drive sprocket.

14. The belt operated container handling system of claim 13 wherein said stationary belt member is anchored at the upper curved portion of the pivoting laterally extendable arm and held by an adjustable tensioning device at the lower end of said arm.

15. The belt operated container handling system of claim 13 further comprising rollers and guide wheels for carrying said base carriage arrangement along said pivoting, laterally extending arm.

16. The belt operated container handling system of claim 11 wherein said stationary belt member is anchored at the upper curved portion of the pivoting laterally extendable arm and held by an adjustable tensioning device that includes a clamping device at the lower end of said arm.

17. A belt operated container handling system of claim 16 further comprising rollers and guide wheels for carrying said base carriage arrangement along said pivoting, laterally extending arm.

18. The belt operated container handling system of claim 17 wherein said guide wheels are connected under said pivoting laterally extending arm in pairs, each pair having a single shaft which with associated structure maintains said base carriage arrangement and said pivoting laterally extending arm.

* * * * *